United States Patent [19]

Müller

[11] Patent Number: 4,461,337

[45] Date of Patent: Jul. 24, 1984

[54] MOLDING INSTALLATION FOR THE PRODUCTION OF BIPARTITE BOXLESS FOUNDRY MOLDS

[75] Inventor: Günter Müller, Karlsruhe, Fed. Rep. of Germany

[73] Assignee: ARENCO-BMD Maschinenfabrik GmbH, Fed. Rep. of Germany

[21] Appl. No.: 159,478

[22] Filed: Jun. 16, 1980

[30] Foreign Application Priority Data

Jun. 15, 1979 [DE] Fed. Rep. of Germany ..... 2924114

[51] Int. Cl.[3] ..... B22C 17/00

[52] U.S. Cl. ..... 164/181; 164/324

[58] Field of Search ..... 164/182, 200, 214, 219, 164/220, 324, 28, 29, 181

[56] References Cited

U.S. PATENT DOCUMENTS 3,878,881 4/1975 Lund et al. ..... 164/200 X
4,135,570 1/1979 Muller ..... 164/182

FOREIGN PATENT DOCUMENTS 2721874 11/1978 Fed. Rep. of Germany ..... 164/200

*Primary Examiner*—Kuang Y. Lin
*Attorney, Agent, or Firm*—Antonelli, Terry & Wands

[57] ABSTRACT

A molding installation for the production of bipartite-boxless foundry molds, comprises a molding machine with a molding station wherein a cope and a drag are simultaneously shaped and a conveying means by which the cope and the drag are conveyed along in a closed path from the molding station to a joining and stripping station where the cope and drag are recombined and from which they are removed together from the complete foundry mold with the empty molding boxes returned to the molding station while the boxless foundry mold is transferred to a casting line. At least one processing station is provided between the molding station and the joining and stripping station for conducting finishing work, such as the insertion of cores, on at least one of the two molds. The conveying means has linear conveying lanes which are arranges in a superimposed relationship (one above the other) along at least part of their lengths, the molding station and the joining and stripping station being located in the superimposed part of the lanes, an upper of the conveying lanes receives the copes and a lower of the conveying lanes receives the drags and at least the lower conveying lane is extended between the molding station and the joining and stripping station so as to enable inclusion of a number of required processing stations. In one embodiment, the upper lanes and lower lanes are constructed to cause the cope and drag to travel through like rectangular paths, while in other embodiments, the rectangular path through which the drags travel is extended relative to the path through which the copes travel.

6 Claims, 3 Drawing Figures

MOLDING INSTALLATION FOR THE PRODUCTION OF BIPARTITE BOXLESS FOUNDRY MOLDS

BACKGROUND AND SUMMARY OF THE INVENTION

The invention relates to a molding installation for the production of bipartite, boxless foundry molds, consisting of a molding machine with a molding station wherein the cope and the drag are simultaneously shaped above a bilateral pattern arranged therebetween and thereafter are lifted off from the pattern in the upward and downward directions, respectively, and of a conveying means by which the cope and the drag are conveyed along a closed path from the molding station of a joining and stripping station where the cope and drag are recombined and then are removed together from the complete foundry mold, and the empty molding boxes are returned to the molding station, while the boxless foundry mold is transferred to a casting line wherein, between the molding station and the joining and stripping station, there is provided at least one processing station for conducting finishing work on at least one of the two molds, for example, for the insertion of cores.

The boxless molding process has the advantage that only a low number of molding boxes is required within the molding installation so that the initial investment costs are correspondingly low. In this connection, especially in large series-type operations, those molding machines proved themselves advantageous, by means of which the cope and the drag are simultaneously shaped. In molding machines of this type, the foundry sand is injected in general from above into the cope and from below into the drag and is thereby compacted, optionally with the aid of an additional pressing step. Then, the cope and drag are lifted off from the pattern disposed therebetween and, optionally after conducting finishing work on both or on one of the two molding boxes, joined together. Thereafter, the molding boxes are closed again with the interposition of the pattern for the production of a new foundry mold. As compared to the individual manufacture of cope and drag, turning processes for one of the two molding boxes are eliminated.

Since in these molding machines the cope and the drag are directly superposed, finishing work on one of the molding boxes can be effected in this position only with difficulties. In a conventional arrangement, the drag, which normally is the only one requiring a finishing step, for example, due to the necessity of inserting cores, is positioned on a turntable with two or three rotary positions. One position pertains to the molding station wherein the pattern is arranged above the drag and the cope is disposed thereabove. After the shaping step, the drag is turned into a position located outside of the molding station and is provided with cores. Thereafter, the drag again enters the molding station from which the pattern has first been removed. In the molding station, the cope is added, the cope and drag are removed, the boxless mold is transferred to the casting line, and the pattern is reintroduced, whereupon a new shaping step takes place. The output of molds is limited and is determined by the work at the coring-up station which generally is conducted manually. Also, the accumulation of working operations within a minimum amount of space is disadvantageous.

In other conventional molding installations (DOS Nos. 2,303,561; 2,721,874), four copes and four drags are arranged on respectively one wheel spider or on respectively one rotary disk passing in succession through various processing stations in four rotary steps. In the molding station, the molding boxes closed over the pattern are filled with foundry sand, the latter is compacted, and then the molding boxes are lifted off the pattern in the upward and downward directions, respectively. After a revolution increment, both molding boxes reach a coring-up station (drag) and, after a further revolution increment, the joining and stripping station wherein the cope and drag are joined and then stripped together off the mold. In a subsequent revolution increment, the empty molding boxes, on the one hand, and the foundry mold, on the other hand, reach a dispatch station wherein the foundry mold is pushed onto a casting line. In the last revolution increment, finally, the two empty molding boxes reenter the molding station.

Although a higher efficiency can be attained with these molding installations, this is achieved at the cost of considerable disadvantages. Since the rotary disks or wheel spiders serving as the conveying means must accommodate in each case four molding boxes simultaneously and, at the same time, must exhibit the necessary moving means for the molding boxes, structural masses result which must be constantly accelerated or decelerated. Furthermore, the drag is accessible only with difficulties at the processing station, since the cope is disposed directly above the drag. Such a molding installation furthermore permits only a limited number of processing stations, normally even only a single processing station, since otherwise the structural masses become too large.

Starting with this prior art, indicated in the foregoing, the invention is based on the object of constructing the molding installation in such a way that it is possible, while avoiding the accumulation of operations within a narrow space, to provide several processing stations, optionally as many processing stations as desired, without thereby reducing the output of molds.

To attain this object, the invention proposes, in place of a rotating system, to equip the conveying means with linear conveying lanes which are superimposed at least along part of their lengths, encompass the molding station and the joining and stripping station in this zone, and of which the upper conveying lane receives the copes, the lower conveying lane receives the drags, and at least the lower conveying lane can be extended by the number of required processing stations.

By means of the molding installation of this invention, a linear conveying means with two conveying paths is suggested instead of a rotating conveying system, which conveying paths are either completely or partially superimposed. In this connection, the arrangement can be such that, at least at the processing station, the cope and the drag (optionally at different heights) are disposed so that they separate from each other and are positioned side-by-side, so that one of the molding boxes (usually the drag) is readily accessible for finishing work. The drive forces of the conveying means can be lower than in the prior art, since the necessary carrying devices and moving means for the molding boxes need not be carried along. The masses to be accelerated and decelerated are less. Also, such an installation can be adapted more readily to existing space conditions, and the processing stations can be distributed so that the finishing operations can be effected unhindered. Finally, the installation permits not only an adaptation to existing requirements, but can also be subsequently altered at any time.

According to one embodiment of the invention, the two superimposed conveying lanes are conducted in a rectangular path and exhibit a linear section comprising the molding station, a readiness station for an empty pair of molding boxes arranged upstream thereof in the conveying direction, and a transfer station arranged therebehind, while the oppositely located linear section exhibits the joining and stripping station, in front thereof the processing station(s), and therebehind a transfer station, the two sections being joined by transverse conveyors.

This arrangement makes it possible to provide an arbitrary number of processing stations for the drag between the transfer station of the first section and the joining and stripping station of the second section, wherein this drag in certain cases will pass through a longer conveying distance than the cope.

A simple variation of this embodiment for only one processing station is distinguished in that the upper and lower conveying lanes exhibit an identical number of stations, and the transfer station of the first section and the processing station of the second section are directly connected by a transverse conveyor.

Another version of the previously described embodiment which is advantageous, in particular, if the drag must pass through more than one processing station is distinguished according to the invention by the feature that the lower conveying path between the transfer station of the first section and the joining and stripping station of the second section is longer by at least the number of processing stations provided, whereas the upper conveying lane connects this transfer station directly with the station located immediately behind the last processing station.

In this version, therefore, the drag passes along a conveying path which is longer by the number of processing stations as compared to the path traveled by the cope, which latter, in turn, is returned along the shortest possible route to the drag associated therewith. It can readily be seen that this version permits any desired number of processing stations with unrestricted access.

To obtain a maximally compact installation in connection with this version, the provision is suitably made to arrange the processing stations so that they are distributed along the mutually opposing sections of the lower conveying lane exhibiting the molding station, on the one hand, and the joining and stripping station, on the other hand, Here the provision is futhermore made that the transverse conveyor connecting these two sections and the transverse conveyor connecting the shorter sections of the upper conveying lane, just as the two transverse conveyors connecting the transfer station on the second section with the readiness station on the first section, are controlled synchronously. In this way, each time a drag is transferred from one section to the other section, a cope is also simultaneously transferred from one section to the other section and, on the other end of the conveying lanes, at the same time an empty pair of molding boxes is brought into the readiness position.

By means of the aforedescribed solution to the problem with which this invention is concerned, it is furthermore possible to construct the molding installation in such a way that the cope as well as the drag can pass through several processing stations. For this purpose, an embodiment is specifically provided which is characterized by the fact that the lower conveying lane is extended in a closed rectangle and comprises a linear section encompassing the molding station, the joining and stripping station, and the readiness station, and an oppositely located, linear second section encompassing the processing stations, both sections being connected by transverse conveyors. This embodiment is furthermore characterized in that the upper conveying lane extends only along the first section, and directly before each transverse conveyor in the travel direction a turning device is arranged, one of these turning devices removing the shaped copes from the upper conveying lane, turning same, and transferring same to the opposed, second section of the lower conveying lane between, respectively, one drag, while the second turning device takes off the cope behind the processing stations from the lower conveying lane, turns same back to the upper conveying lane, and correlates this cope with the drag located thereat. In this connection, finally, the provision is made that the cope and the drag are advanced on the section of the lower conveying lane exhibiting the processing stations upon each conveying step by two positions, while they advance on the opposite section, just as the drags on the transverse conveyors, only by one position upon each conveying increment.

Thus, on one linear section of the two conveying lanes, encompassing the molding station, the cope and the drag are respectively superimposed, while they are arranged side-by-side on the opposite section with the processing stations. Thereby finishing work can be conducted on copes and drags. Since at the end of this section each second molding box, namely respectively the cope, is taken off and turned back to the opposite section, it is ensured by the dual step executed with each conveying increment that the entire molding installation operates in the rhythm of the molding machine, i.e. the mold output is determined exclusively by the efficiency of the molding machine. Here too, it can be readily seen that any desired number of processing stations can be provided, without thereby reducing the output of molds.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
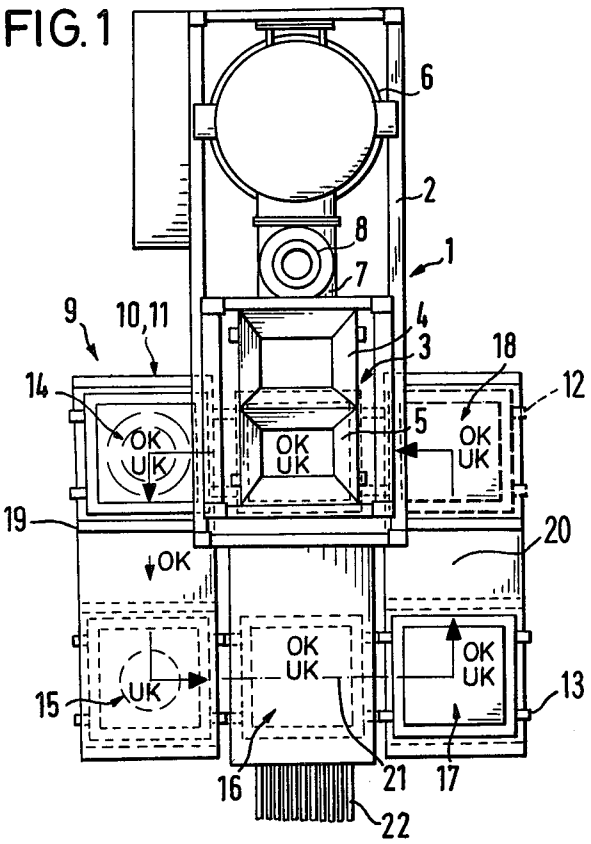
FIG. 1 is a top view of a first, simple embodiment of the molding installation.

The molding installation according to FIG. 1 comprises a molding machine 1; in the illustrated embodiment this molding machine is one wherein the foundry sand is compacted by being injected into the cope and the drag and by being subsequently compressed. Since such molding machines are known in a great variety of designs see e.g. U.S. Pat. No. 3,744,549, only a few details are illustrated and described herein. The molding machine 1 has a frame 2, a molding station 3 being provided in the forward zone thereof. A movable charging vessel with two filling hoppers 4, 5 for the foundry sand can be seen above the molding station 3. The cope mold box OK is filled by means of the feeding hopper 5, whereas a downwardly extending chute adjoins the feeding hopper 4, the foundry sand being fed therethrough to the drag UK. A blast box is provided between this chute and the drag mold box (just as between the feeding hopper 5 and the cope mold box) wherein compressed air can be applied to the foundry sand. The compressed air is stored in a tank 6 in the rearward zone of the machine frane 2 and passes via a lower conduit 7 into the lower blast box via an upwardly extended conduit 8 into the upper blast box. The bilateral pattern is arranged (in a manner not recognizable in the drawing) between the two mold boxes OK and UK; the cope and the drag are attached thereto from above and below, respectively. The pattern is seated on an extensible carrier to be optionally exchangeable.

The molding machine 1 is associated with a conveying means 9 consisting of a lower conveying lane 10 and an upper conveying lane 11. The two conveying lanes 10, 11 are arranged at such a level that they can take over the cope mold boxes OK and drag mold boxes UK, lifted upwardly and downwardly, respectively, within the molding station 3, at the predetermined level.

The two conveying lanes 10, 11 consist of two linear sections 12, 13. A readiness station 18 is arranged on section 12 in the conveying direction directly in front of the molding station 3, and behind the molding station 3 a transfer station 14 is located. On the opposite section 13, a processing station 15 is positioned, followed by a joining and stripping station 16, and a transfer station 17. The two sections 12, 13 are closed to a rectangle by means of transverse conveyors 19, 20.

The copes in mold boxes OK and drags in mold boxes UK, which have been shaped and lifted off the pattern in the molding station 3, pass along the section 12 of the conveying lanes 10, 11 into the transfer station 14, with their relative position with respect to each other remaining the same. Simultaneously an empty pair of box molds OK/UK passes into the transfer station 17 on the other section 13. During the subsequent synchronous operating phase of the transverse conveyors 19, 20, the thus-shaped box pair passes into the processing station 15, and the empty box mold pair passes into the readiness station 18. In the processing station 15, cores are inserted in the drags UK. The cope OK and the drag UK then travel from the processing station 15 along the linear section 13 of the conveying lanes into the joining and stripping station 16. In the latter, the cope in mold box OK is first joined with the drag in mold box UK, and then the mold boxes OK and UK are stripped together off the foundry mold. The boxless foundry mold is thereafter dispatched to the casting line 22 by means of a pusher, not shown, while the empty pair of box molds OK, UK passes along the linear section 13 into the transfer station 17 and from there, in turn, via transverse conveyor 20 into the readiness station 18.

Figure 2:
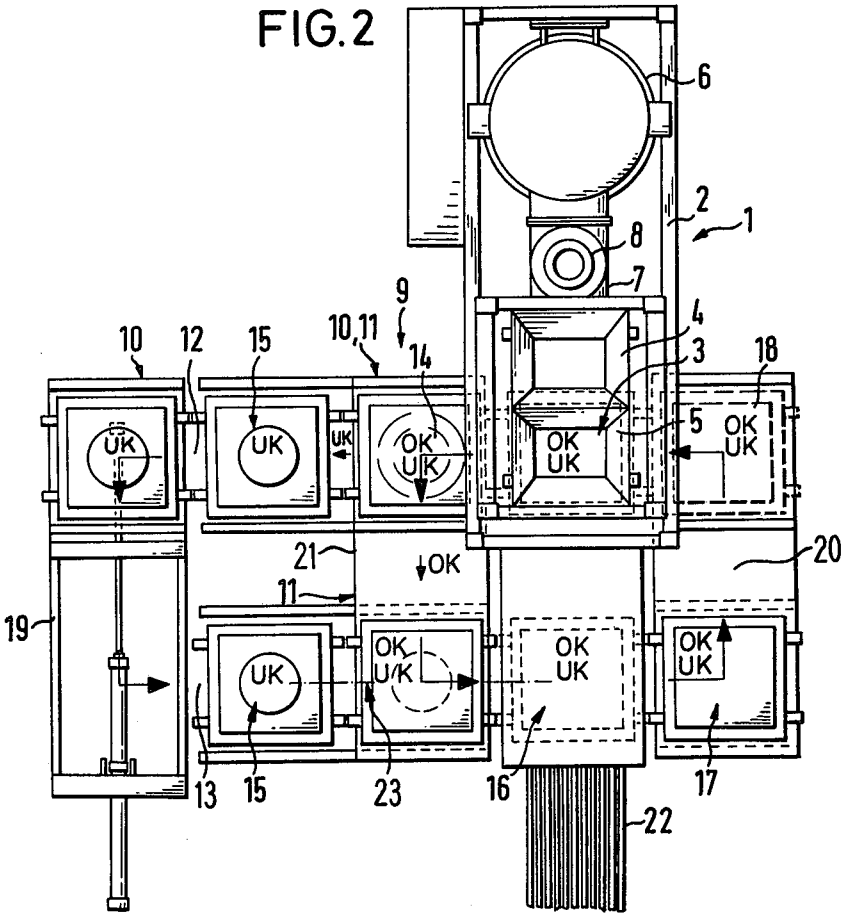
FIG. 2 shows a top view, similar to that of FIG. 1, of an expanded embodiment of the molding installation.

In the embodiment of FIG. 2, the same molding machine is utilized; for this reason, there is no need to describe same at this point. The conveying means 9 again has two linear conveying lanes 10, 11 which, however, in this case are only partially in superimposed arrangement. Both conveying lanes 10, 11 have a linear section 12 with the readiness station 18, the molding station 3, and a transfer station 14, as well as an opposed section 13 with the joining and stripping station 16 and the transfer station 17. The latter is connected with the readiness station 18, in turn, by a common transverse conveyor 20 for the empty pair of molding boxes OK-/UK. In contrast to the arrangement of FIG. 1, the transfer station 14 on the first section 12 is connected only on the upper conveying lane 11 with the opposite section 13 by means of a transverse conveyor 21, whereas the lower conveying lane 10 is of a greater length and has two processing stations 15, of which respectively one is arranged on one of the two sections 12, 13. Both linear sections 12, 13 of the lower conveying lane 10 are connected between the two processing stations 15 by a lower transverse conveyor 23.

The copes in mold boxes OK and drags in mold boxes UK shaped in the molding station 3 pass, after having been lifted off the pattern, on the linear section 12 of the two conveying lanes 10, 11 to the transfer station 14. In the latter, the drag in mold box UK is moved along this linear section of the lower conveying lane 10 (toward station 15) whereas the cope in mold box OK passes at the right angles thereto and along a direct path by way of the transverse conveyor 21 to the opposite section 13 of the upper conveying lane and is there associated with a finished drag UK already located at that point.

The drag UK present at the first processing station 15 is moved along, after termination of the finishing work to be conducted therein, on the linear section 12 to the transverse conveyor 19, passes from there to the opposite section 13 of the lower conveying lane, from there to the subsequent processing station 15' and from there finally, after conclusion of all finishing operations, into station 23 to which the copes in mold boxes OK are transferred from the transfer station 14. The cope in mold box OK and the drag in mold box UK pass from this station into the joining and stripping station 16, from which the boxless foundry mold is dispatched to the casting line 22, while the empty pair of box molds OK, UK is transferrred into the transfer station 17 and from there via the common transverse conveyor 20 into the readiness station 18. The conveying means operate in phase along the linear sections 12, 13, as well as in the region of the transverse conveyors 19, 20, and 21, this phase being furthermore adapted to the cycle of the molding machine 1.

It can be seen from the drawing and its description that the number of processing stations 15 for the drags UK is theoretically unlimited without thereby impairing the output of molds to the casting line 22 in any way. The output is merely dependent on the operating speed of the molding machine 1. In this regard, it is noted that, upon initial startup of a particular drag, a specified number of drags only will be molded in station 3, this number being equal to the difference between the number of stations through which the drag UK and cope OK will pass.

Figure 3:
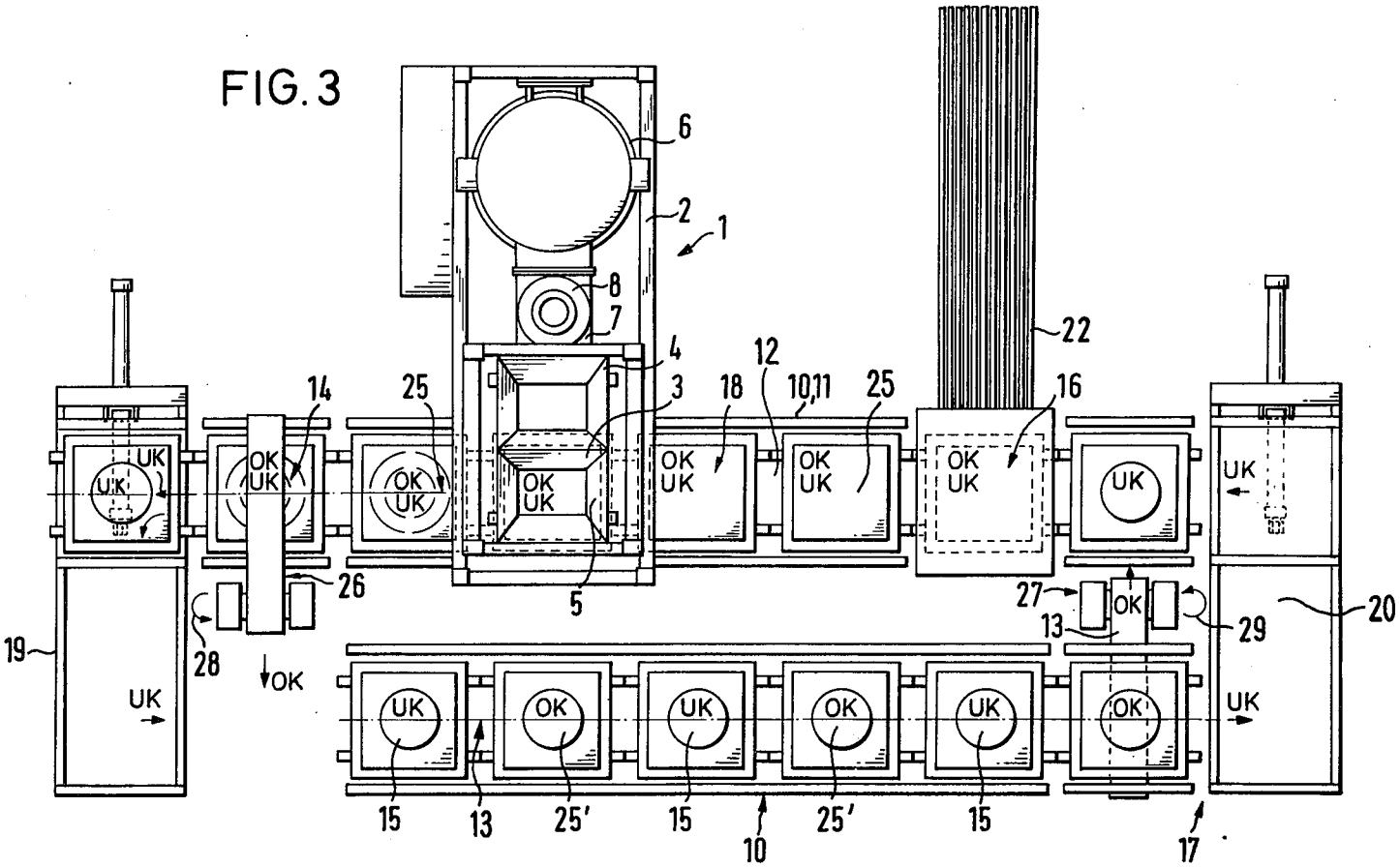
FIG. 3 shows a similar top view of a third embodiment of the molding installation.

FIG. 3 shows an embodiment of the molding installation wherein finishing work is executed on the drag in box UK as well as on the cope in box OK, for example cores are inserted and runners and risers can be drilled. In this embodiment, the two conveying lanes 10, 11 again extend along a portion of a linear section 12 encompassing the molding station 3 and, in this case, also the joining and stripping station 16 and the readiness station 18. The upper conveying lane 11, however, extends only to this portion of the linear section 12.

On the opposite section 13, constituted only by a lower conveying lane 10, there is an alternating arrangement of processing stations 15 for the drag in box UK and processing stations 25' for the cope in box OK. The lower conveying lane 10 does not only consist of the linear sections 12, 13 but, as in the afore-described embodiments of a transverse conveyor 19 connecting same and a further transverse conveyor 20. Directly in front of these two transverse conveyors 19, 20, respectively one turning device 26, 27 is arranged between the two sections 12, 13. The turning device 26 seizes the cope OK (including a conveying lane section) arranged in the transfer station 14 on the linear section 12 of the upper conveying lane 11, and pivots the cope in the direction of arrow 28 to the opposed, linear section 13 of the lower conveying lane 10, namely directly behind a drag in mold box UK located at the first processing station 15.

In contrast thereto, the drag in mold box UK, released at the transfer station 14, travels along the linear section 12 into the transverse conveyor 19, is shifted by the latter to the linear section 13, and is there transferred, together with the cope in mold box OK located in front thereof, to the processing stations 15, whereas the cope in mold box OK moves into processing stations 25'. On the linear section 13 of the lower conveying lane 10, the copes boxes OK and the drags boxes UK are shifted by respectively two positions, whereas the box mold pairs OK/UK arranged in mutual superposition on the section 12 of the lower and upper conveying lanes 10, 11 are advanced merely by respectively one station.

At the end of the linear section 13, each finished cope box mold OK is, in turn, seized by the turning device 27 and turned back to the upper conveying lane 11 of the opposite section 12 in the direction of arrow 29, where the cope in box mold OK is simultaneously correlated with a drag box mold UK located on the lower conveying lane 10. Due to the dual cycle of the conveying means in the zone of the linear section 13, the drag UK located at the last processing station 15 is passed with each dual cycle into the transverse conveyor 20, whereas the subsequent cope in box mold OK passes into the turning range of the turning device 27. Along the linear section 12, finally, the copes in box molds OK and drags box molds UK pass into the joining and stripping station 16, from which the boxless foundry mold is dispatched to the casting line 22, whereas the empty pair of box molds OK, UK is passed on to the readiness station 18.

It can also be seen from this illustration and its description that this embodiment permits an arbitrary number of processing stations for copes in box molds OK and drags box molds UK. Optionally, empty positions are inserted. along the conveying lanes 10, 11. Such an empty position 25 is located for example, between the joining and stripping station 16 and the readiness station 18, as well as between the molding station 3 and the transfer station 14.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Molding installation for the production of bipartite, boxless foundry molds, comprising a molding machine with a molding station wherein a cope and a drag are simultaneously shaped in molding boxes with a bilateral pattern arranged therebetween and thereafter are lifted off from the pattern in upward and downward directions, respectively, and a conveying means by which the molding boxes with the cope and the drag are conveyed separately along a closed path from the molding station to a joining and stripping station where the mold boxes with the cope and drag are recombined, then are removed together from the complete foundry mold, and the empty molding boxes are returned to the molding station, while the boxless foundry mold is transferred to a casting line, wherein, between the molding station and the joining and stripping station, there is provided at least one processing station for conducting finishing work on at least one of the cope and drag, characterized in that said closed path along which the molding boxes are conveyed from the molding station is a rectangular one; in that the conveying means has upper conveying lanes for the copes and lower conveying means for the drags, said upper and lower conveying lanes having linear sections arranged in a parallel superimposed relationship along at least part of their lengths; in that the molding station and the joining and stripping station are separately located in respective areas of said linear sections where the upper and lower conveying lanes are in said superimposed relationship; in that at least the lower conveying lane includes a number of required processing stations and the length of the path along which said molding boxes are separately conveyed with the cope and drag is adapted to the respective processing stations included therein; and in that a portion of said lower conveying lane, between said molding station and said joining and stripping station, extends, at least in part, beyond said upper conveying lane so as not to be in said superimposed relationship with said upper conveying lane, said number of processing stations being located in said portion.

2. Molding installation according to claim 1, characterized in that the upper and lower conveying lanes each have a first linear section encompassing the molding station, a readiness station, arranged in front thereof in the conveying direction, for an empty pair of box molds, and a first transfer station arranged thereafter, and a second, opposite linear section which comprises the joining and stripping station preceded by said number of processing stations and followed by a second transfer station; and that said linear sections are connected by transversely extending conveyors.

3. Molding installation according to claim 2, characterized in that the upper and lower conveying lanes have an identical number of stations and the first transfer station of one linear section is directly connected with the processing station of the other section by means of one of said transverse conveyor.

4. Molding installation according to claim 2, having more than one processing station for the drags, characterized in that the lower conveying lane, between the transfer station and the joining and stripping station of the second section is longer than the upper conveying lane by at least the number of the processing stations provided, the upper conveying lane directly connecting the first transfer station with the station arranged immediately behind the last processing station.

5. Molding installation according to claim 4, characterized in that the processing stations are arranged distributed along the mutually opposite sections of the lower conveying lane, between the molding station on the one hand, and the joining and stripping station, on the other hand; and that the transverse conveyors connecting these two sections are controlled in synchronism.

6. Molding installation for the production of bipartite, boxless foundry molds, comprising a molding machine with a molding station wherein a cope and a drag are simultaneously shaped in molding boxes with a bilateral pattern arranged therebetween and thereafter are lifted off from the pattern in upward and downward directions, respectively, and a conveying means by which the molding boxes with the cope and the drag are conveyed separately along a closed path from the molding station to a joining and stripping station where the mold boxes with the cope and drag are recombined, then are removed together from the complete foundry mold, and the empty molding boxes are returned to the molding station, while the boxless foundry mold is transferred to a casting line, wherein, between the molding station and the joining and stripping station, there is provided at least one processing station for conducting finishing work on at least one of the cope and drag, characterized in that said closed path along which the molding boxes are conveyed from the molding station is a rectangular one; in that the conveying means has upper conveying lanes for the copes and lower conveying means for the drags, said upper and lower conveying lanes having linear sections arranged in a parallel superimposed relationship along at least part of their lengths; in that the molding station and the joining and stripping station are separately located in respective areas of said linear sections where the upper and lower conveying lanes are in said superimposed relationship; in that at least the lower conveying lane includes a number of required processing stations and the length of the path along which said molding boxes are separately conveyed with the cope and drag is adapted to the respective processing stations included therein; and further characterized.in that the lower conveying lane exhibits a first linear section encompassing the molding station, the joining and stripping station, a readiness station and a second linear section opposite the first section and comprising the processing station, both said sections being connected by transverse conveyors; that the upper conveying lane extends only along the first section; and that, as seen in the conveying direction, a turning device is arranged immediately in front of each transverse conveyor, one of these turning devices removing shaped copes from the upper conveying lane, turning same, and transfering same to the opposite second section of the lower conveying lane between respective drags, whereas the second turning device removes the cope from the lower conveying lane, turns same back to the upper conveying lane, and associates same with a drag provided at that location;,and that means for stepwise advancing the cope and the drag are provided for advancing same by two positions during each conveying step along the second section of the lower conveying lane comprising the processing stations and for advancing same by only one position on the first section and on the transverse conveyors.

* * * * *